United States Patent [19]

Walter et al.

[11] 4,013,022

[45] Mar. 22, 1977

[54] SHELVING APPARATUS

[75] Inventors: Florian A. Walter; Edward C. Stewart, both of Aurora, Ill.

[73] Assignee: Lyon Metal Products, Incorporated Aurora, Ill.

[22] Filed: Dec. 2, 1971

[21] Appl. No.: 203,973

[52] U.S. Cl. ..... 108/114; 248/243

[51] Int. Cl. ..... A47G 29/02

[58] Field of Search ..... 108/114, 109, 111, 107, 108/108; 248/243; 211/148, 177

[56] References Cited

UNITED STATES PATENTS

| | | | |
|---|---|---|---|
| 1,056,486 | 3/1913 | Bales | 108/109 |
| 1,235,679 | 8/1917 | Gerberich | 108/114 |
| 1,336,971 | 4/1920 | Levene | 248/243 |
| 1,577,066 | 3/1926 | Medart | 248/243 X |
| 1,660,898 | 2/1928 | Worley | 108/114 |
| 1,753,012 | 4/1930 | Levene | 248/243 |
| 2,261,956 | 11/1941 | Brownlie | 248/243 |
| 3,081,717 | 3/1963 | Yurevich | 248/243 X |
| 3,269,338 | 8/1966 | Shewell | 108/109 X |
| 3,507,399 | 4/1970 | Gruenberg | 108/111 X |
| 3,522,920 | 8/1970 | Gray | 211/148 X |

*Primary Examiner*—Francis K. Zugel
*Attorney, Agent, or Firm*—Prangley, Dithmar, Vogel, Sandler & Stotland

[57] ABSTRACT

Shelving apparatus includes a pair of spaced-apart support posts, each post having two back-to-back plates of different widths cooperating to define a recess for receiving therein one end of an associated closure panel extending between the posts, two longitudinally extending parallel rows of openings in the plates, corresponding openings in the two rows being aligned transversely of the plates, first and second shelf clips respectively disposed on opposite sides of each post in horizontal alignment with each other, each clip having a hook-shaped finger extending therefrom adjacent to one side edge thereof and an aperture therethrough adjacent to the other side edge thereof, the clip being disposed in use with the finger extending through a selected opening in one of the rows for latching engagement with the associated post and with the aperture disposed in registry with the transversely aligned opening in the other row of openings, the apertures being dimensioned and arranged freely to accommodate the attachment finger of the clip mounted on the opposite side of the post for permitting clips on the opposite sides of the post to be mounted and demounted independently of each other, and a shelf having a marginal flange disposed between the mounting clips and the support posts for mounting the shelf thereon.

22 Claims, 13 Drawing Figures

FIG.3
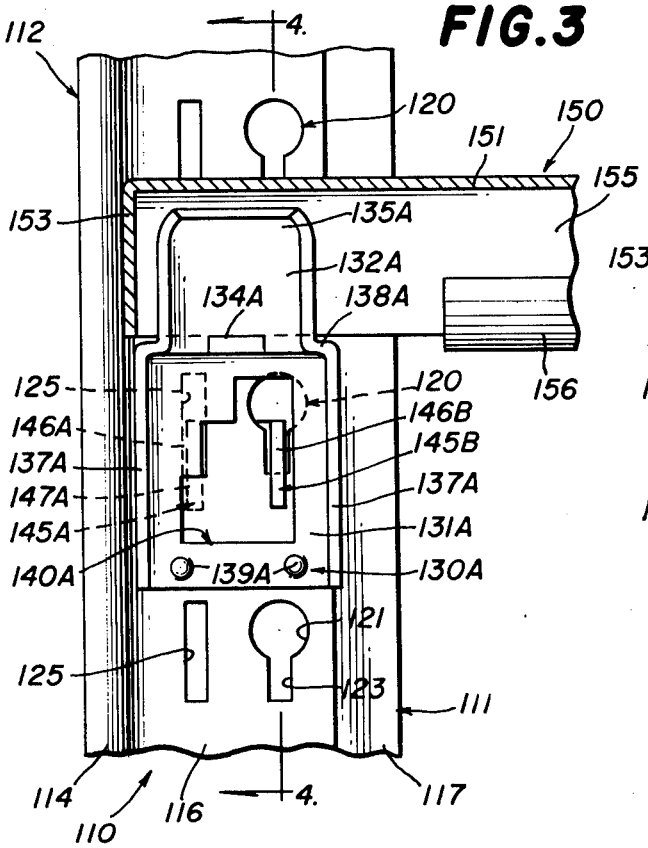
FIG.4
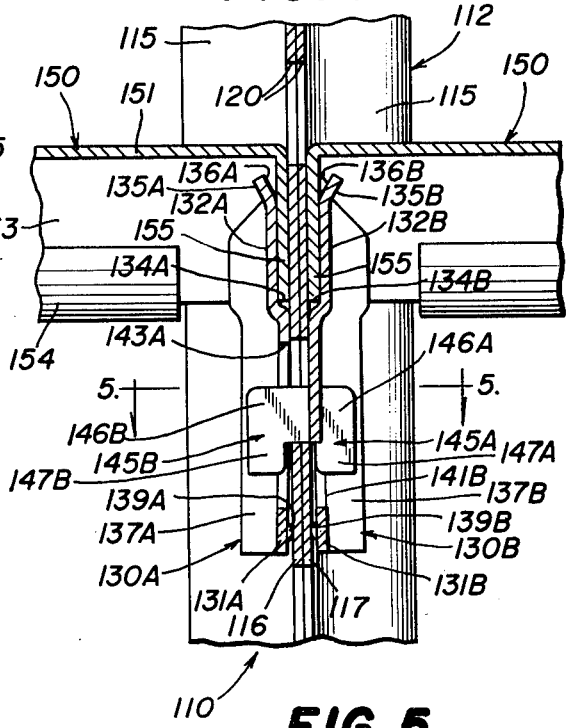
FIG.5
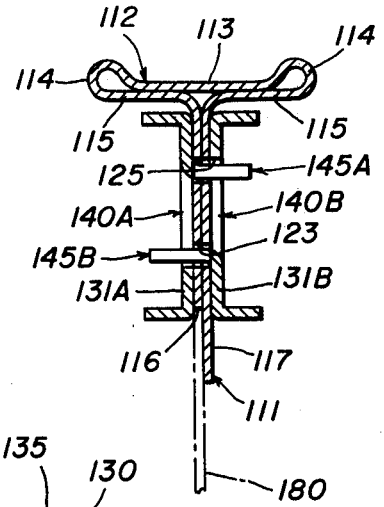
FIG.6
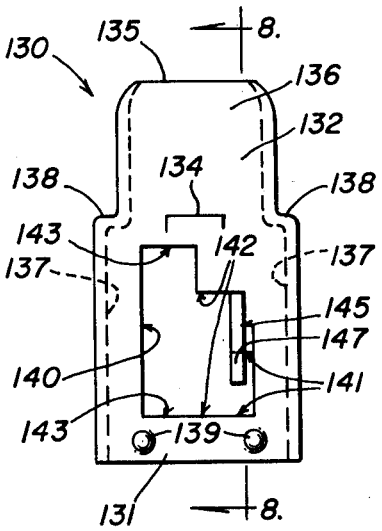
FIG.7
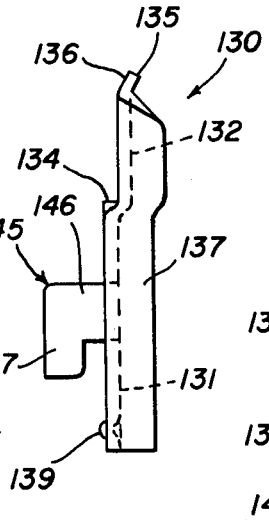
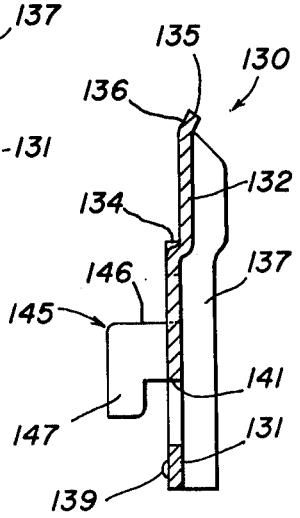
FIG.8

SHELVING APPARATUS

The present invention relates to shelving structure and particularly to what is known as commercial shelving, which is a rugged, rigid type of shelving having provision for a number of shelves which may be spaced adjustably thereon.

Among the objects of this invention is to provide a novel support post for the shelving structure which is simply and economically fabricated from a single piece of sheet metal stock, being adapted for supporting horizontally aligned shelves on the opposite sides thereof.

Another general object of this invention is to provide a novel mounting clip integrally formed of a single piece of material and adapted for mounting on either side of a support post without interference with a like mounting clip mounted on the opposite side of the support post.

It is an important object of the present invention to provide shelving structure comprising an upstanding support post having a row of spaced-apart openings therein aligned longitudinally thereof, a shelf clip having an integral attachment finger extending therefrom and receivable in a selected one of the openings in the support post for mounting engagement therewith, the clip having an upwardly extending retaining portion disposed in use in facing relationship with the support post and spaced a predetermined distance therefrom, and a shelf having a top and a marginal flange depending therefrom, the flange being receivable between the retaining portion of the shelf clip and the facing portion of the support post for mounting the shelf thereon.

Another object of this invention is to provide shelving structure comprising a pair of upstanding spaced-apart support posts, each of the support posts including two generally rectangular interconnected parallel plates disposed in back-to-back relationship, one of the rectangular plates extending transversely a predetermined distance beyond the adjacent side edge of the other of the rectangular plates and cooperating therewith to define an attachment recess, the support posts being disposed in use with the rectangular plates of one post being respectively substantially co-planar with the rectangular plates of the other post, a closure panel extending between the posts with the opposite ends of the panel respectively disposed in the attachment recesses substantially parallel to the one rectangular plate and in edge-to-edge abutting relationship with the other of the rectangular plates, thereby to facilitate attachment of the panel to the support posts, and a shelf mounted on the support posts.

Still another object of the present invention is to provide shelving structure of the type set forth, wherein the support post is provided with first and second substantially parallel rows of spaced-apart openings therein aligned longitudinally thereof, the openings in the first row being respectively aligned with corresponding openings in the second row transversely of the support post, first and second identically constructed shelf clips of the type set forth respectively disposed on opposite sides of the support post in horizontal alignment with each other, each clip having the attachment finger thereof disposed adjacent to one side edge thereof and having an aperture therein disposed adjacent to the other side edge thereof for registry with an opening in one of the rows when the attachment finger is received in the transversely aligned opening in the other of the rows, whereby in use the attachment fingers of the first and second mounting clips are respectively accommodated in the apertures of the second and first mounting clips.

In connection with the foregoing object, it is another object of this invention to provide shelving structure of the type set forth, wherein each of said attachment fingers is generally hook-shaped, the shelf clip being movable in the post opening between an inserted position with the bottom of the finger disposed above the bottom of the opening to accommodate passage therethrough and a latching position with the bottom of the finger disposed below the bottom of the opening on the opposite side of the support post for latching engagement therewith, the aperture being so dimensioned and arranged as to freely accommodate movement of the first and second shelf clips between the inserting positions and the latching positions thereof independently of each other.

Still another object of this invention is to provide shelving structure of the type set forth, wherein each of the support posts further includes a pair of flanges respectively integral with the rectangular plates along the other side edges thereof and extending outwardly therefrom substantially normal thereto, the outer ends of the flanges being respectively bent back to form a pair of part cylindrical stiffening portions, and an outer web disposed substantially parallel to the flanges and integral with and interconnecting the stiffening portions thereof.

Still another object of this invention is to provide a shelf clip for mounting a shelf having a marginal flange depending therefrom upon an upstanding support post having a row of spaced-apart openings therein aligned longitudinally thereof, the shelf clip comprising a body portion, an attachment finger integral with the body portion and extending outwardly therefrom substantially normal thereto, the attachment finger being receivable in a selected one of the openings in the associated support post for mounting engagement therewith, and a retaining portion integral with the body portion and extending upwardly therefrom, the retaining portion being disposed in use in facing relationship with the associated support post and spaced a predetermined distance therefrom, the marginal flange of the associated shelf being receivable between the retaining portion and the associated support post for mounting the associated shelf.

Yet another object of this invention is to provide an upstanding support post for supporting an associated shelf thereon, the support post comprising two generally rectangular parallel plates disposed in back-to-back relationship, one of the rectangular plates extending transversely a predetermined distance beyond the adjacent side edge of the other of the rectangular plates and cooperating therewith to define an attachment recess, the recess being adapted to accommodate therein one end of an associated panel disposed parallel to the one rectangular plate and in edge-to-edge abutting relationship with the other rectangular plate thereby to facilitate attachment of the support post to the associated panel, and means rigidly interconnecting the parallel plates.

Further features of this invention pertain to the particular arrangement of the parts of the shelving structure whereby the above-outlined and additional operating features thereof are attained.

The invention, both as to its organization and method of operation, together with further objects and advantages thereof, will best be understood by reference to the following specification taken in connection with the accompanying drawings, in which:

FIG. 3 is a further enlarged fragmentary view in vertical section taken along the line 3—3 in FIG. 1;

FIG. 4 is a fragmentary view in vertical section taken along the line 4—4 in FIG. 3, and illustrating the cooperation between the shelf clips on opposite sides of a support post;

FIG. 5 is a view in horizontal section taken along the line 5—5 in FIG. 4;

FIG. 6 is a rear elevational view of a shelf clip constructed in accordance with and embodying the features of the present invention;

FIG. 7 is a side elevational view of the shelf clip illustrated in FIG. 6;

FIG. 8 is a view in vertical section taken along the line 8—8 in FIG. 6;

Figure 1:
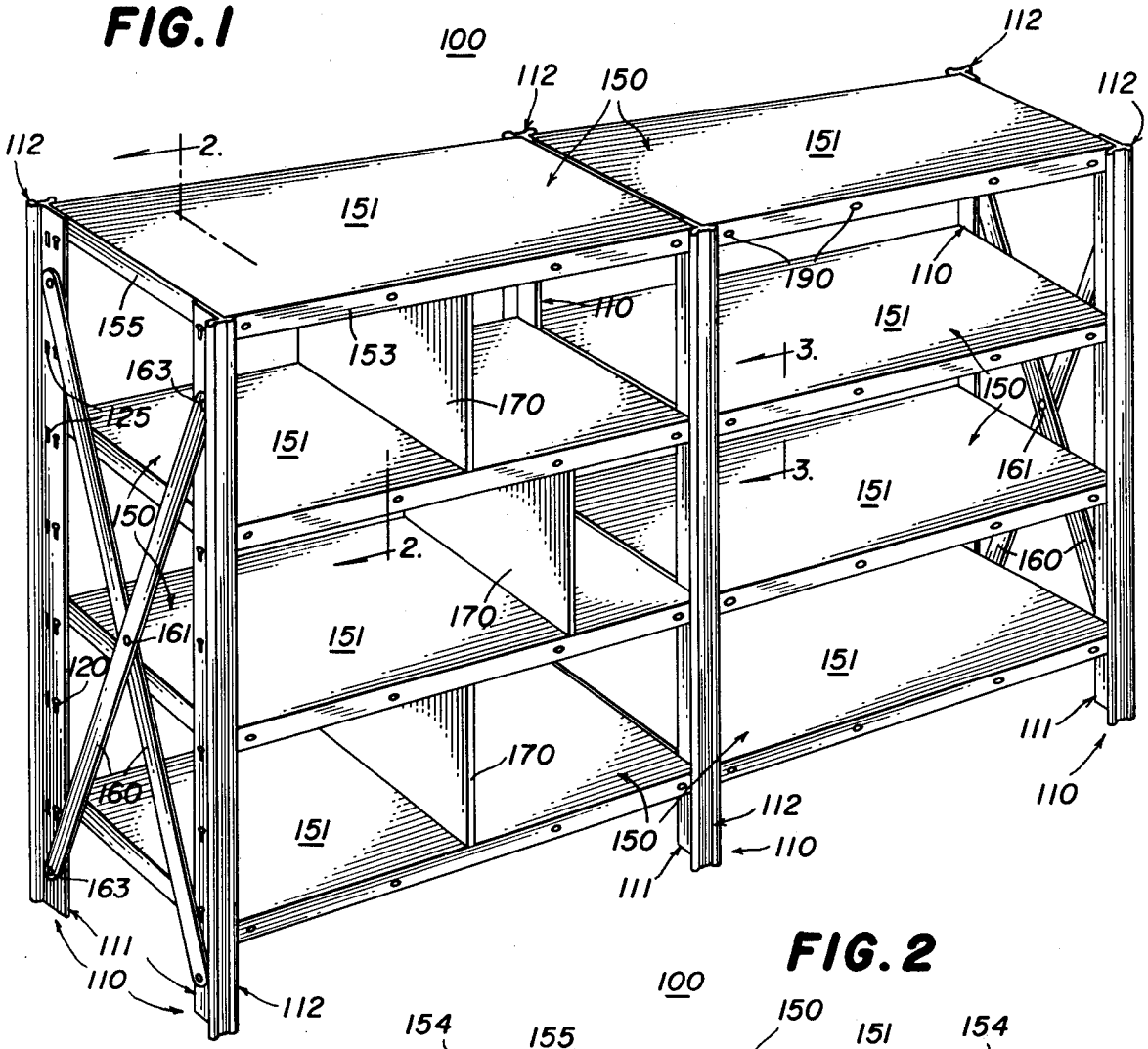
FIG. 1 is a perspective view of an assembled configuration of the shelving structure constructed in accordance with and embodying the features of the present invention.
Figure 2:
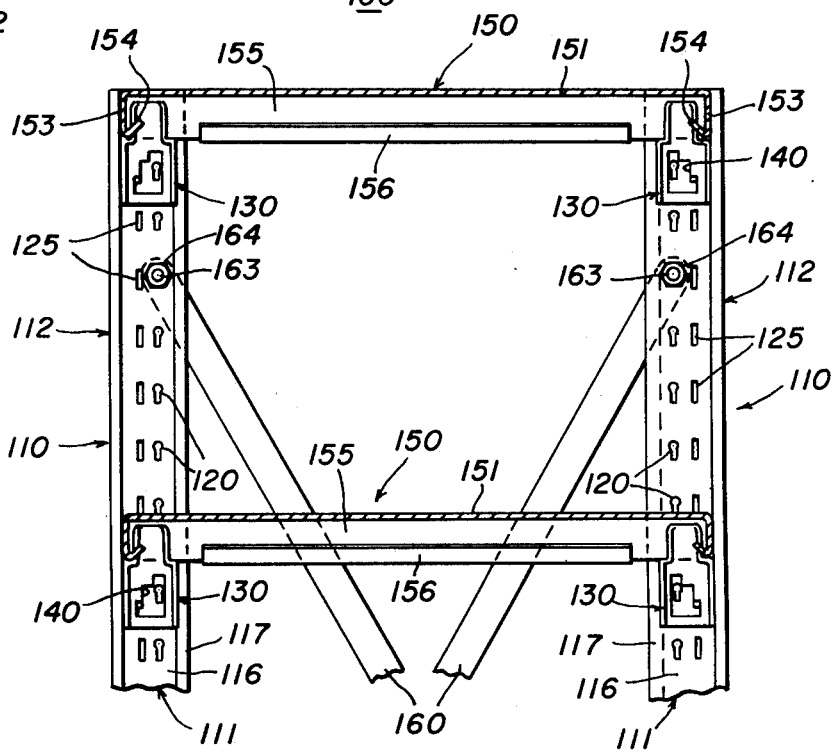
FIG. 2 is an enlarged view in vertical section taken along the line 2—2 in FIG. 1, and illustrating the cooperation among the support posts, shelf clips, shelves and end braces of the present invention.

Referring now in particular to FIG. 1 of the drawings, there is shown a shelving structure, generally designated by the numeral 100, constructed in accordance with and embodying the features of the present invention. The shelving structure 100 includes a plurality of pairs of upstanding support posts, generally designated by the numeral 110, supporting therebetween a plurality of shelves 150. The shelving structure 100 is designed to be assembled in units, each unit including four of the support posts 110 arranged in a rectangular formation and supporting the shelves 150 thereon. Where two or more units are to be assembled together, additional pairs or corner posts 110 are added, FIG. 1 illustrating shelving structure including two of these assembled units, six of the support posts 110 being provided for this purpose. The general configuration and arrangement of the parts of the shelving structure 100 is similar to that disclosed in U.S. Pat. No. 2,604,213, issued on July 22, 1952, to J. E. Bales et al., and assigned to the assignee of the present invention.

Figure 9:
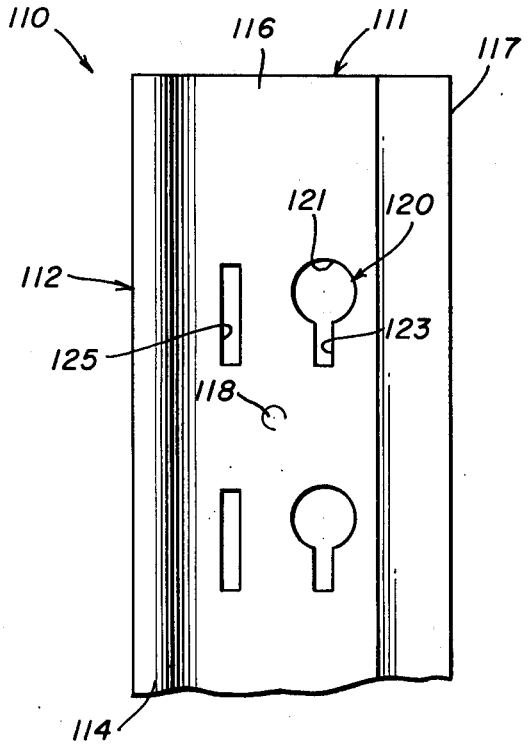
FIG. 9 is an enlarged fragmentary side elevational view of one of the support posts constructed in accordance with and embodying the features of a first embodiment of the present invention.
Figure 10:
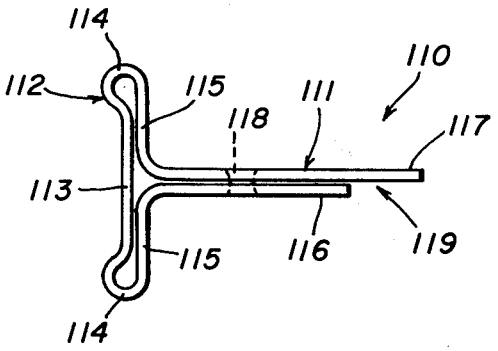
FIG. 10 is a top plan view of the support post illustrated in FIG. 9.

Referring now also to FIGS. 9 and 10 of the drawings, each of the support posts 110 is generally "T"-shaped in transverse cross-section and includes a stem portion 111 and a crossbar portion 112. The crossbar portion 112 comprises a flat elongated generally rectangular crossbar 113 being provided at the lateral side edges thereof with part circular end ribs 114, each of the ribs 114 being integral with a short flat flange 115, the flanges 115 extending inwardly toward each other substantially parallel to the crossbar 113 and closely adjacent thereto. The flanges 115 are respectively integral at the inner ends thereof with a relatively narrow generally rectangular flat leg plate 116 and a relatively wide flat leg plate 117, the leg plates 116 and 117 being disposed closely adjacent to and substantially parallel to each other and cooperating to form the stem portion 111 of the support post 110. Each of the end ribs 114, flanges 115 and leg plates 116 and 117 extends longitudinally the entire length of the crossbar 113, the distal side edge of the wide leg 117 extending a predetermined distance beyond the distal side edge of the narrow leg plate 116 and cooperating therewith to define a notch or recess 119 for a purpose to be described more fully hereinafter. Preferably, the leg plates 116 and 117 are interconnected at spaced-apart points therealong as by spot welds 118 to form a rigid stem portion 111 for the support post 110. Further, it will be appreciated that the part circular end ribs 114 serve to stiffen and maintain the straightness of the crossbar portion 112 of the support post 110.

Each of the support posts 110 is provided with a row of equidistantly spaced-apart generally keyhole-shaped openings 120 aligned longitudinally thereof, the openings 120 extending through both of the leg plates 116 and 117 and being disposed adjacent to the distal side edge of the narrow leg plate 116. The openings 120 are all identical, each including a part-circular top portion 121 communicating at the bottom thereof with a generally rectangular bottom portion 123 which extends downwardly a predetermined distance from the circular portion 121, the width of the rectangular portion 123 transversely of the post stem portion 111 being substantially less than the diameter of the part circular portion 121. Each of the support posts 110 is also provided with another row of identically shaped openings or slots 125 equidistantly spaced apart longitudinally of the support post 110, each of the openings 125 extending through both of the leg plates 116 and 117 and being disposed adjacent to the crossbar portion 112 of the support post 110. Each of the openings 125 is disposed a predetermined distance from and in alignment with a corresponding one of the openings 120 transversely of the stem portion 111, each opening 125 being rectangular in shape having a width substantially equal to the width of the rectangular portion 123 of the corresponding opening 120 and having a length substantially equal to the longitudinal extent of the corresponding opening 120.

Each support post 110 is integrally constructed of a single piece of sheet metal and is preferably fabricated by roll-forming to the "T"-shaped configuration illustrated in the drawings. In a preferred constructional example of the present invention, the support post 110 is constructed of 16-gauge hot-rolled pickled steel and is continuously formed through a series of rolls, the part circular end ribs 114 providing strength and rigidity of the support post 110, as described above. The leg plates 116 and 117 are spot welded on 3-inch centers and have the parallel rows of openings 120 and 125 punched therein on 1-½-inch centers as the sheet material progresses through the roll form line at a maximum speed of approximately 50 feet per minute. The roll-formed "T"-shaped post stock is then cut off to form individual upright support posts 110 of any desired length. It will, of course, be appreciated that the spacing of the openings 120 and 125 and the speed of passage through the roll form line may be varied, as desired.

Referring now to FIGS. 2 and 6 through 8 of the drawings, the shelving structure 100 is further provided with a plurality of shelf clips, generally designated by the numeral 130, each of the shelf clips 130 including a flat substantially rectangular base or body plate 131. Integral with the body plate 131 at the upper end thereof and extending upwardly therefrom substantially parallel thereto is a retaining head 132, the head 132 being generally rectangular in shape and having a width slightly less than the width of the body plate 131, the retaining head 132 further being offset laterally with respect to the body plate 131 and defining a pair of shoulders 138 at the opposite side edges of the retaining head 132. A short tab 134 extending transversely of the body plate 131 is shear formed therefrom centrally of the upper end thereof to define a seat or pedestal immediately behind the retaining head 132, for a purpose to be described more fully below.

Integral with the side edges respectively of the body plate 131 and the retaining head 132 along the entire length thereof are two side flanges 137 extending outwardly from the body plate 131 and the retaining head 132 substantially normal thereto and cooperating therewith to provide a generally channel-shaped transverse cross-section for the shelf clip 130. Integral with the retaining head 132 at the upper edge thereof and inclined upwardly and rearwardly therefrom in the direction of the side flanges 137 is a top lip 135 which extends substantially the entire width of the retaining head 132 between the side flanges 137. The front of the top lip 135 defines an inclined camming surface 136 for a purpose to be described more fully below. Disposed adjacent to the bottom edge of the body plate 131 and projecting rearwardly therefrom in the direction opposite to the side flanges 137 are two laterally spaced-apart bosses 139.

The body plate 131 has formed therein an irregularly-shaped aperture 140 including a relatively short rectangular region 141, an intermediate rectangular region 142, and a relatively long rectangular region 143, respectively arranged from right to left, as viewed in FIG. 6, the bottom part of the opening 140 having a width slightly greater than the distance between the outer edges of an opening 125 and the rectangular portion of the corresponding opening 120 in the post 110. The long rectangular region 143 of the aperture 140 is disposed adjacent to the lefthand side edge of the body plate 131, as viewed in FIG. 6, and extends longitudinally from just below the pedestal 134 to just above the bosses 139.

Integral with the body plate 131 and extending therefrom in the direction opposite to the side flanges 137 substantially parallel thereto is a generally hook-shaped attachment finger 145. The attachment finger 145 includes an upper or base portion 146 integral with the body plate 131 along the right-hand side edge of the intermediate region 142 of the aperture 140, as viewed in FIG. 6, and extending longitudinally from the upper edge of the intermediate aperture region 142 to the upper edge of the short aperture region 141. Integral with the base portion 146 at the outer end thereof and extending downwardly therefrom to a point approximately midway between the upper and lower edges of the short region 141 of the aperture 140, is a distal end portion 147. The total extent of the finger 145 longitudinally of the shelf clip 130 is slightly less than the longitudinal extents of the openings 120 and 125, and the thickness of the finger 145 is slightly less than the transverse widths of the openings 120 and 125.

Preferably, the shelf clip 130 is integrally formed of a single piece of metal such as 12-gauge steel, the regions 141 and 143 of the aperture 140 being punched from the body plate of 131 of the clip 130 to form the outline of the distal end 147 of the hook member 145, which distal end is then sheared along the upper edge thereof and bent toward one of the side flanges 137 to form the rearwardly projecting attachment finger 145 and the upper edge of the intermediate region 142 of the aperture 140.

Each of the shelves 150 is preferably formed of sheet metal and includes a flat horizontally extending top 151 which is rectangular in shape. Integral with the top 151 along the front and rear edges thereof and extending downwardly therefrom substantially normal thereto are front and rear flanges 153, the lower end of each of the flanges 153 being provided with an integral lip 154 which is inclined upwardly and inwardly of the shelf 150, the opposite ends of each lip 154 being respectively spaced from the corresponding ends of the associated flange 153 a distance greater than the width of the side flanges 137 of the shelf clip 130. Integral with the top 150 at the opposite side edges thereof and extending downwardly therefrom substantially normal thereto are two side flanges 155, each of the side flanges 155 being provided at the lower edge thereof with an integral lip 156 inclined upwardly and inwardly of the shelf 150, the opposite ends of each lip 156 being respectively spaced from the corresponding ends of the associated flange 155 a distance greater than the width of the retaining head 132 of the shelf clip 130.

Bosses or dimples (not shown) may be formed in each of the front and rear flanges 153 adjacent to the opposite ends thereof and projecting inwardly therefrom to space the flanges 153 from the associated shelf clips 130. Also, if desired, each of the flanges 153 may be provided with a reinforcing band (not shown) receivable between the flange and the associated lip 154 or 156. The construction, arrangement and function of such dimples and reinforcing bands are described in detail in the aforementioned U.S. Pat. No. 2,604,213.

In assembling the shelf structure 100, as illustrated in FIG. 1, the upright support posts 110 are arranged in pairs in a rectangular formation, the pairs being spaced apart a distance substantially equal to the length of a shelf 150, the support posts 110 in each pair thereof being spaced-apart a distance substantially equal to the front-to-back width of the shelf 150 and arranged with the stem portions 111 of the posts 110 extending inwardly toward each other in substantially coplanar relationship. As can best be seen in FIGS. 1 and 2, when the posts 110 are so arranged, the rows of keyhole-shaped openings 120 will be disposed inwardly of the formation.

Attached to each of the posts 110 is at least one of the shelf clips 130 for each shelf to be supported thereon. In operation, the shelf clip 130 is arranged opposite a predetermined pair of the openings 120 and 125 at the height selected for mounting of the shelf 150, with the attachment finger 145 extending toward the stem portion 111 of the post 110 and substantially in alignment with a predetermined one of the transversely aligned openings 120 and 125 and with the long region 143 of the aperture 140 in registry with the other of the openings 120 and 125. The attachment finger 145 is then moved through the aligned one of the openings 120 and 125 to an inserting position (not shown) with the bottom edge of the finger 145 disposed above the bottom edge of the aligned opening 120 and 125, and is then lowered to a latching position with the bottom edge of the base portion 146 of the attachment finger 145 supported on the mounting post 110 at the bottom of the selected opening therethrough, and with the distal end 147 of the attachment finger 145 disposed entirely on the opposite side of the stem portion 111 of the mounting post 110 and extending downwardly below the bottom edge of the aligned opening therethrough for latching engagement therewith. This latching position is illustrated by the positions of the shelf clips 130A and 130B shown in FIGS. 3 to 5, as will be explained more fully below.

It will be appreciated that, in this latching position, withdrawal of the shelf clip 130 from engagement with the mounting post 110 cannot be effected without upward movement of the shelf clip 130, thereby effectively preventing accidental disengagement of the shelf clip 130 from the support post 110. Movement of the shelf clip 130 between the inserting and latching positions thereof is facilitated by the bosses 139 which slidably engage the facing surface of the stem portion 111 of the support post 110. In like manner, shelf clips 130 are attached to each of the other support posts 110 at the same vertical level.

It will be appreciated that in the configuration illustrated in FIG. 1, if two of the shelves 150 are to be disposed in end-to-end relationship and in horizontal alignment with each other, it will be necessary to attach shelf clips 130 on both sides of each of the intermediate ones of the support posts 110 at the same vertical level. It is an important feature of the present invention to provide a construction of the support posts 110 and the shelf clips 130 which permits two of the shelf clips 130 to be freely mounted and demounted at the same vertical level or opposite sides of a support post 110 completely independently of each other.

Referring to FIGS. 3 through 5 of the drawings, there is illustrated one of the intermediate support posts 110 shown in FIG. 1, with the shelf clips 130 on opposite sides of the support post 110 being respectively designated by the postscripts "A" and "B" to facilitate the description. It will be appreciated that the shelf clips 130A and 130B are identical to each other and to the shelf clip 130 shown in FIGS. 6 to 8, the postscripts "A" and "B" being added simply to designate their positions on opposite sides of the post 110. Referring in particular to FIG. 3, it will be seen that the mounting clip 130A is arranged with the attachment finger 145A thereof in alignment with a selected one of the rectangular openings 125 and with the large region of the aperture 140A in registry with the corresponding keyhole-shaped opening 120. It will be noted that when the clip 130A is disposed in its latching position illustrated in FIG. 3, the large portion of the aperture 140A extends longitudinally from a point closely adjacent to the top of the keyhole-shaped opening 120 to a point well below the bottom end thereof.

Accordingly, it will be appreciated that the shelf clip 130B on the opposite side of the support post 110 may be moved into a latching position at the same vertical level, with the attachment finger 145B extending through the keyhole-shaped opening 120 and with the aperture 140B disposed in registry with the rectangular opening 125. Thus, the attachment finger 145B will be accommodated in the aperture 140A, while the attachment finger 145A is accommodated in the aperture 140B.

Further, it will be observed from FIGS. 3 and 4 of the drawings, that when the shelf clips 130A and 130B are thus disposed in the latching positions thereof, the bottom edge of the aperture 140A is disposed below the bottom edge of the attachment finger 145B a distance equal to the distance between the bottom edge of the base portion 146A and the bottom edge of the distal end 147A of the attachment finger 145A. Further, the upper edge of the aperture 140B is disposed that same predetermined distance above the upper edge of the attachment finger 145A. Thus, it will be understood that each of the shelf clips 130A and 130B can readily be moved between the inserting positions and the latching positions thereof and can be withdrawn from engagement with the support post 110 without in any way interfering with each other, whereby the shelf clips 130A and 130B can be freely mounted or demounted independently of each other.

After the shelf clips 130 have been mounted in place in the appropriate openings in the support posts 110, the shelves 150 are placed in position between the corner posts 110 and the depending flanges 153 and 155 are inserted over the retaining heads 132 on the shelf clips 130 and between the retaining heads 132 and the mounting posts 110. More particularly, referring to FIG. 2 of the drawings, each of the front and rear flanges 153 of the shelf 150 is disposed between the retaining head 132 of the clip 130 and the adjacent flange 115 of the mounting post 110. Each of the side flanges 155 of the shelf 150 extends between the retaining head 132 of the shelf clip 130 and the stem portion 111 of the support post 110, insertion of the flange 155 over the shelf clip retaining head 132 being facilitated and guided by the inclined camming surface 136 on the top lip 135 (see FIGS. 7 and 8).

It will be noted that the retaining head 132 of the shelf clip 130 is offset from the body plate 131 thereof a distance substantially equal to the thickness of the flange 155 whereby the flange 155 may be securely wedged between the shelf clip retaining head 132 and the support post stem portion 111. The flange 155 is moved to a position with the bottom edge thereof resting upon the pedestal 134 of the shelf clip 130, which position is best illustrated in FIGS. 3 and 4 with respect to shelf clips 130A and 130B. The shelf 150 is now rigidly held at its four corners and the shelf 150 in turn assists in rigidifying the four corner posts 110 to form a stable and a rigid shelf structure. As will be apparent from FIGS. 1 and 2, any desired number of shelves 150 may be mounted in the shelf structure 100, the minimum vertical spacing between shelves being approximately 3 inches in the preferred embodiment of the invention, as dictated by the length of the shelf clip 130. As illustrated in FIG. 4, two of the shelves 150 may be held in horizontal alignment on opposite sides of a common stem portion 111 of one of the support posts 110 by reason of the unique construction of the support posts 110 and the shelf clips 130A and 130B which permit the shelf clips 130A and 130B to be independently mounted at the same vertical level on opposite sides of the same support post 110, as explained above.

In instances where open-ended shelving is utilized and where relatively heavy objects are going to be supported on the shelves, it is desirable to support the shelving in such a manner that the load will be carried directly by the upright support posts 110 themselves. To this end, there is provided the bracing structure illustrated in FIGS. 1 and 2 of the drawings. This bracing structure includes two elongated metal bracing straps 160 at each end of the shelving structure 100, the bracing straps 160 being crossed as illustrated and each bracing strap 160 extending from a point adjacent to the bottom of one of the end support posts 110 to a point adjacent to the top of the other end support post 110. The cross bracing straps 160 are secured together at the crossover point as by rivet 161, the opposite ends of each of the bracing straps 160 being attached to the adjacent support post 110 by means of attachment bolts 163 and nuts 164. MOre particularly, it will be seen that the bolts 163 extend through a complementary opening in the end of bracing strap 160 and through the part-circular portion 121 of a selected one of the keyhole-shaped openings 120. It will, of course, be appreciated that the circular portions of the keyhole-shaped openings 120 will also permit other types of accessory equipment to be bolted to the support post 110, if desired.

In addition to the foregoing, a plurality of partition plates or dividers 170, preferably flanged at the top and bottom thereof, may be disposed between vertically adjacent shelves for subdividing the inter-shelf space. The flanges (not shown) at the top and bottom of the dividers 170 are attached to the shelf tops 151 by means which are more fully described in the aforementioned U.S. Pat. No. 2,604,213.

Figure 11:
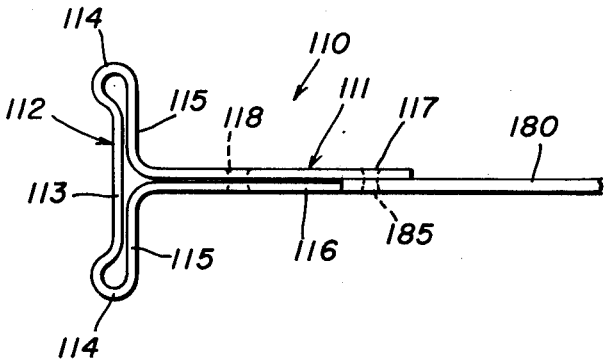
FIG. 11 is a view similar to FIG. 10, and illustrating a preferred mode of attachment of an end closure plate to the support post.

In lieu of the open-ended shelving structure illustrated in FIG. 1, it may be desirable to close the ends of the shelf structure 100 as by a rectangular closure panel 180 (see FIG. 11). It is a significant feature of the present invention that the different widths of the leg plates 116 and 117 of the support posts 110 serve greatly to facilitate the attachment of an end panel 180 thereto. Thus, referring to FIG. 11, it will be seen that a rectangular end closure panel 180 may be disposed between the stem portions 111 of a pair of support posts 110 at one end of the shelving structure 100, the opposite side edges of the closure panel 180 being respectively received in the recesses 119, in parallel overlapping relationship with the wide leg plate 117 and in end-to-end abutting relationship with the narrow leg plate 116. The closure panel 180 may then be secured to the support posts 110 as by spot weldments 185, thereby to provide a clean and smooth end closure without any protruding fastening means or other projections, in lieu of the cross braces 160.

It will also be understood that it may be desirable to close the back of the shelving structure 100. For this purpose, back closure panels (not shown) may be secured to the rear ones of the depending flanges 153 on the shelves 150 by suitable means such as screws or bolts receivable in complementary openings 190 in the shelf flanges 153. The construction and mounting of such a back closure panel is more specifically disclosed in the aforementioned U.S. Pat. No. 2,604,213.

Figure 12:
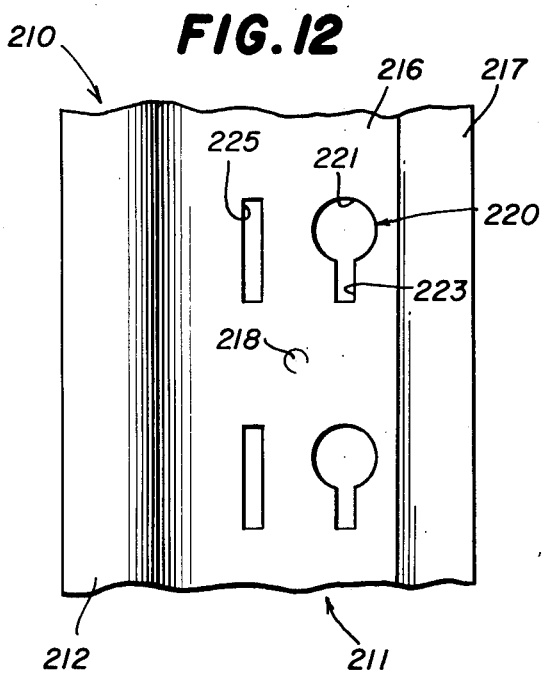
FIG. 12 is a fragmentary side elevational view, similar to FIG. 9, and illustrating a second embodiment of the support post of the present invention.
Figure 13:
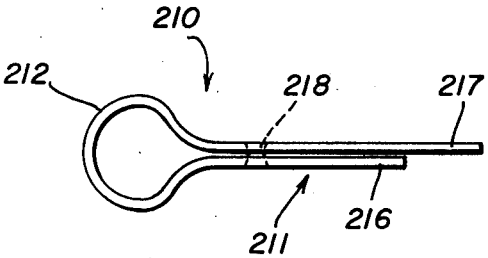
FIG. 13 is a top plan view of the support post illustrated in FIG. 12.

Referring to FIGS. 12 and 13 of the drawings, there is illustrated an alternative embodiment of the support post of the present invention, generally designated by the numeral 210. The support post 210 includes a generally part-cylindrical body portion 212 having integral therewith a relatively narrow leg plate 216 and a relatively wide leg plate 217 extending therefrom substantially parallel to each other. The leg plates 216 and 217 are constructed and arranged identically to the leg plates 116 and 117 of the support post 110, and are secured together at spaced-apart points therealong to define a rigid stem portion 211 of the support post 210. Formed in the stem portion 211 is a row of equidistantly spaced-apart openings 220 extending through both the leg plates 216 and 217 and aligned longitudinally of the stem portion 211. The openings 220 are generally keyhole-shaped including a part-circular upper portion 221 and a rectangular lower portion 223 and are dimensioned and arranged identically to the openings 120 in the support posts 110. Similarly, the stem portion 211 is provided with a row of spaced-apart rectangular openings 225 dimensioned and arranged identically to the rectangular openings 125 in the support post 110.

The support post 210 is preferably assembled in a configuration like that shown in FIG. 1, with the front one of each pair of posts being a post 210 and the rear one of each pair being a post 110. Otherwise shelving structure is assembled in exactly the same manner as was described above with respect to the shelving structure 100 in FIG. 1. Further, the support post 210 is preferably integrally formed of a single piece of sheet metal material, such as 16-gauge hot-rolled pickled steel, which is roll-formed to the configuration illustrated in the drawings. It will be appreciated that the relatively small lateral dimension of the body portion 212 as compared with the body portion 112 of the support post 110, will afford an increased entry opening between adjacent front support posts 210 to facilitate the loading of merchandise onto the shelves 150.

From the foregoing, it will be seen that there has been provided a novel shelving structure of simple and economical construction which affords easy assembly and disassembly.

More particularly, there has been provided a shelving structure including novel supports posts integrally formed of single pieces of sheet metal and provided with parallel rows of spaced-apart openings therein for accommodating the mounting of shelf supporting clips on either side of the support posts at the same vertical level.

In addition, there have been provided two embodiments of support posts of the character described, each of which embodiments is characterized by a stem portion having leg plates of different widths cooperating to define a recess which facilitates the attachment thereto of an end closure panel.

There has also been provided a unique form a shelf mounting clip integrally constructed of a single piece of material and provided with an attachment finger and an aperture therein so constructed and arranged as to permit mounting of two of said clips on opposite sides of the single support post at the same vertical level without interference with each other.

While there have been described what are at present considered the preferred embodiments of the invention, it will be understood that various modifications may be made therein, and it is intended to cover in the appended claims all such modifications as fall within the true spirit and scope of the invention.

What is claimed is:

1. Shelving structure comprising a pair of upstanding spaced-apart support posts, each of said support posts including two generally rectangular interconnected parallel plates disposed in back-to-back relationship, one of said rectangular plates extending transversely a predetermined distance beyond the adjacent side edge of the other of said rectangular plates and cooperating therewith to define an attachment recess, said support posts being disposed in use with the rectangular plates of one post being respectively substantially coplanar with the rectangular plates of the other of said posts, a closure panel extending between said posts with the opposite ends of said panel respectively disposed in said attachment recesses in overlapping parallel relationship with said one rectangular plate and in edge-to-edge abutting relationship with said other of said rectangular plates thereby to facilitate attachment of said panel to said support posts, and a shelf mounted on said support posts.

2. The shelving structure set forth in claim 1, wherein said parallel plates of each of said posts are continuously interconnected along the side edges thereof opposite said attachment recess.

3. The shelving structure set forth in claim 1, wherein said parallel plates of each of said posts are welded together at spaced-apart points therealong.

4. The shelving structure set forth in claim 1, and further including part cylindrical end structure integral with and interconnecting said parallel plates of each of said posts along the side edges thereof opposite said attachment recess.

5. Shelving structure comprising a pair of upstanding spaced-apart support posts, each of said support posts including two generally rectangular interconnected parallel plates disposed in back-to-back relationship, one of said rectangular plates extending transversely a predetermined distance beyond the adjacent side edge of the other of said rectangular plates and cooperating therewith to define an attachment recess, said support posts being disposed in use with the rectangular plates of one post being respectively substantially coplanar with the rectangular plates of the other of said posts, said support post having a row of spaced-apart openings extending through said interconnected parallel plates and aligned longitudinally thereof, a shelf clip having an integral attachment finger receivable in a selected one of said openings in said support post for mounting engagement therewith, said shelf clip having an upwardly extending retaining head disposed in use in facing relationship with said support post and spaced a predetermined distance therefrom, a closure panel extending between said posts with the opposite ends of said panel respectively disposed in said attachment recesses in overlapping parallel relationship with said one rectangular plate and in edge-to-edge abutting relationship with said other of said rectangular plates thereby to facilitate attachment of said panel to said support posts, and a shelf having a top and a marginal flange depending therefrom, said flange being receivable between said retaining heads of said shelf clip and the facing portions of said support posts for mounting said shelf thereon.

6. The shelving structure set forth in claim 5, and further including a plurality of spaced-apart pairs of said support posts disposed in rectangular formation, and a plurality of said shelf clips respectively engageable with said support posts, said shelf top being rectangular in sahpe and said marginal flange depending from said top around the entire periphery thereof, said flange being receivable between said retaining heads of said shelf clips and said support posts for mounting said shelf thereon.

7. Shelving structure comprising an upstanding support post having first and second substantially parallel rows of spaced-apart openings therein aligned longitudinally thereof, the openings in said first row being respectively aligned with corresponding openings in said second row transversely of said support post, first and second identically constructed shelf clips respectively disposed on opposite sides of said support post in horizontal alignment with each other, each of said shelf clips having an attachment finger extending therefrom adjacent to one side edge thereof and receivable in the openings in said rows of openings for mounting engagement with said support post, each of said shelf clips having an aperture therein disposed adjacent to the other side edge thereof for registry with an opening in one of said rows when said attachment finger is received in the transversely aligned opening in the other of said rows, said first shelf clip being disposed in use with said attachment finger thereof received in a selected opening in said first row of openings and with said aperture thereof disposed in registry with the transversely aligned opening in said second row of openings, said second shelf clip being disposed in use with said attachment finger thereof received in said transversely aligned opening in said second row of openings and with said aperture thereof disposed in registry with said selected opening in said first row of openings, the attachment fingers of said first and second shelf clips being respectively disposed in use through the apertures of said second and first shelf clips, each of said shelf clips having an upwardly extending retaining head disposed in use in facing relationship with the adjacent side of said support post and spaced a predetermined distance therefrom, and two shelves respectively disposed on opposite sides of said support post and each having a top and a marginal flange depending therefrom, said flanges being respectively receivable between said retaining heads of said shelf clips and the facing portions of said support post for mounting said shelves thereon.

8. The shelving structure set forth in claim 7, wherein each of the openings in said first row of openings is rectangular, each of the openings in said second row being generally keyhole-shaped and including a part circular upper portion having a diameter substantially greater than the width of the openings in said first row and a rectangular lower portion having a width substantially equal to the width of the openings in said first row, the longitudinal extent of each opening in said first row being equal to the longitudinal extent of the adjacent opening in said second row, the part circular portion of said keyhole-shaped openings accommodating attachment of associated auxiliary apparatus to said support post.

9. The shelving structure set forth in claim 7, wherein each of said shelf clips is integrally constructed of a single piece of material.

10. The mounting clip set forth in claim 7, wherein each of said shelf clips further includes a pair of bosses protruding therefrom adjacent to the lower end thereof in the same direction as said attachment finger, said bosses facilitating sliding movement of said shelf clip to the mounted position thereof on said support post.

11. Shelving structure comprising an upstanding support post having first and second substantially parallel rows of spaced-apart openings therein aligned longitudinally thereof, the openings in said first row being respectively aligned with corresponding openings in said second row transversely of said support post, first and second identically constructed shelf clips respectively disposed on opposite sides of said support post in horizontal alignment with each other, each of said shelf clips having a generally hook-shaped attachment finger extending therefrom adjacent to one side edge thereof and receivable in the openings in said rows of openings for mounting engagement with said support post, each of said shelf clips being movable in said opening between an inserting position with the bottom of said finger disposed above the bottom of said opening to accommodate passage therethrough and a latching position with the bottom of said finger disposed below the bottom of said opening on the opposite side of said support post for latching engagement therewith, each of said shelf clips having an aperture therein disposed adjacent to the other side edge thereof for registry with an opening in one of said rows when said attachment finger is received in the transversely aligned opening in the other of said rows, said first shelf clip being disposed in use with said attachment finger thereof received in a selected opening in said first row of openings and with said aperture thereof disposed in registry with the transversely aligned opening in said second row of openings, said second shelf clip being disposed in use with said attachment finger thereof received in said transversely aligned opening in said second row of openings and with said aperture thereof disposed in registry with said selected opening in said first row of openings, the attachment fingers of said first and second shelf clips being respectively disposed in use through the apertures of said second and first mounting clips, said apertures being so dimensioned and arranged as to freely accommodate movement of said first and second shelf clips between the inserting positions and the latching positions thereof independently of each other, each of said shelf clips having an upwardly extending retaining head disposed in use in facing relationship with the adjacent side of said support post and spaced a predetermined distance therefrom, and two shelves respectively disposed on opposite sides of said support post and each having a top and a marginal flange depending therefrom, said flanges being respectively receivable between said retaining heads of said shelf clips and the facing portions of said support post for mounting said shelves thereon, whereby either of said first and second shelf clips may be mounted and demounted without disturbing the other.

12. The shelving structure set forth in claim 11, wherein each of said hook-shaped attachment fingers includes a base portion integral with said shelf clip and extending laterally outwardly therefrom substantially normal thereto, and an end portion integral with said base portion and extending downwardly therefrom, whereby when said shelf clip is disposed in the latching position thereof said base portion of said hook extends through the associated opening in said support post for engagement therewith at the bottom of said opening and said end portion of said hook is disposed on the opposite side of said support post below the associated opening to prevent lateral withdrawal of said finger from said opening.

13. The shelving structure set forth in claim 11, wherein said attachment finger is disposed to the right-hand side of said shelf clip when viewed from the side thereof from which said finger extends.

14. Shelving structure comprising a pair of upstanding spaced-apart support posts, each of said support posts including two generally rectangular interconnected parallel plates disposed in back-to-back relationship, one of said rectangular plates extending transversely a predetermined distance beyond the adjacent side edge of the other of said rectangular plates and cooperating therewith to define an attachment recess, said support posts being disposed in use with the rectangular plates of one post being respectively substantially coplanar with the rectangular plates of the other of said posts, a pair of flanges respectively integral with said rectangular plates along the other side edges thereof and extending outwardly therefrom substantially normal thereto, the outer ends of said flanges being respectively bent back to form a pair of part cylindrical stiffening portions, an outer web disposed substantially parallel to said flanges and integral with and interconnecting the stiffening portions thereof, a closure panel extending between said posts with the opposite ends of said panel respectively disposed in said attachment recesses in overlapping parallel relationship with said one rectangular plate and in edge-to-edge abutting relationship with said other of said rectangular plates thereby to facilitate attachment of said panel to said support posts, and a shelf mounted on said support posts.

15. The shelving structure set forth in claim 14, wherein each of said stiffening portions of said support post extends outwardly beyond said outer web.

16. The shelving structure set forth in claim 14, wherein each of said support posts is integrally constructed of a single piece of sheet metal.

17. A shelf clip for mounting a shelf having a marginal flange depending therefrom upon one side of an upstanding support post having first and second substantially parallel rows of spaced-apart openings therein aligned longitudinally and transversely thereof and for accommodating the mounting of a like shelf by a like clip on the opposite side of the support post at the same vertical height, said shelf clip comprising a generally flat rectangular body portion, an attachment finger integral with said body portion adjacent to one side edge thereof and extending outwardly therefrom substantially normal thereto, said body aperture extending there-
with an opening in one of said
when said attachment finger is received in the
transversely aligned opening in the other of said
rows, said attachment finger being receivable through
a selected one of the openings in either one of said
rows in the associated support post for mounting
engagement therewith with said aperture disposed in
registry with the transversely aligned opening in the
other of said rows for accommodating the attachment
finger of a like shelf clip mounted at the same vertical
height on the other side of the support post, and a
retaining head integral with said body portion and
extending upwardly therefrom, said retaining head
being disposed in use in facing relationship with the
associated support post and spaced a predetermined
distance therefrom, the marginal flange of the associ-
ated shelf being receivable between said retaining
head and the associated support post for mounting
the associated shelf.

The shelf clip set forth in claim 17, wherein said
portion is generally channel-shaped in transverse
section.

The shelf clip set forth in claim 17, wherein said
retaining head includes a guide lip at the upper end
inclined outwardly therefrom in a direction
to the direction in which said attachment
ends, said guide lip having an inclined cam
thereon for facilitating insertion of the
flange of the associated shelf between said
head and the associated support post.

upstanding support post for supporting
shelf thereon, said support post comprising
rectangular of said flanges being respectively bent back to form
a pair of part cylindrical stiffening portions, and an
outer web disposed substantially parallel to said
flanges and integral with and interconnecting the
stiffening portions thereof, and means rigidly inter-
connecting said parallel plates.

21. The upstanding support post set forth in claim
20, and further including part cylindrical end structure
integral with and interconnecting said parallel plates
along the side edges thereof opposite said recess.

22. An upstanding support post for supporting an
associated shelf thereon, said support post comprising
two generally rectangular parallel plates disposed in
back-to-back relationship, one of said rectangular
plates extending transversely a predetermined dis-
tance beyond the adjacent side edge of the other of
said rectangular plates and cooperating therewith to
define an attachment recess, said recess being adapted
to accommodate therein one end of an associated
panel disposed in overlapping parallel relationship
with said one rectangular plate and in edge-to-edge
abutting relationship with said other rectangular plate
thereby to facilitate attachment of said support post
to the associated panel, a pair of flanges respectively
integral with said rectangular plates along the other
side edges thereof and extending outwardly
substantially normal thereto, the marginal
flanges being respectively bent back to form
of part cylindrical stiffening portions, the